US009085027B2

(12) United States Patent
Abe et al.

(10) Patent No.: US 9,085,027 B2
(45) Date of Patent: Jul. 21, 2015

(54) METHOD OF MANUFACTURING A TUBULAR MEMBER

(75) Inventors: Kishiro Abe, Ayase (JP); Takamitsu Takano, Ayase (JP); Koji Takeuchi, Ayase (JP); Katsuki Kato, Atsugi (JP); Takayuki Nonaka, Tahara (JP); Satoru Miyashita, Ebina (JP); Tsuneo Watanabe, Ayase (JP); Kenji Taguchi, Chigasaki (JP); Akira Nakamura, Ayase (JP); Yuji Iwakura, Toyokawa (JP)

(73) Assignee: Topy Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/108,660

(22) Filed: May 16, 2011

(65) Prior Publication Data

US 2011/0214474 A1 Sep. 8, 2011

Related U.S. Application Data

(63) Continuation of application No. PCT/JP2009/069529, filed on Nov. 18, 2009.

(30) Foreign Application Priority Data

Nov. 18, 2008 (JP) ..... 2008-294272
Nov. 18, 2009 (JP) ..... 2009-262425

(51) Int. Cl.
*B21D 53/30* (2006.01)
*B21D 22/02* (2006.01)
*B21D 45/00* (2006.01)

(52) U.S. Cl.
CPC ..... *B21D 53/30* (2013.01); *B21D 22/025* (2013.01); *B21D 45/003* (2013.01)

(58) Field of Classification Search
CPC ..... B21D 22/02; B21D 22/025; B21D 22/06; B21D 28/14; B21D 35/001; B21D 41/04; B21D 53/30; B21D 45/003; B21D 45/02
USPC ..... 72/352, 356, 359, 349, 370.14, 105, 72/106; 29/894.353
See application file for complete search history.

(56) References Cited

U.S. PATENT DOCUMENTS 3,258,833 A 7/1966 Schuttler et al.
3,438,111 A 4/1969 Wilcox (Continued)

FOREIGN PATENT DOCUMENTS

JP 58-016751 1/1983
JP 61-042430 2/1986

(Continued)

OTHER PUBLICATIONS

English Language Abstract of JP 2004-512693 published Apr. 30, 2004.

(Continued)

*Primary Examiner* — Shelley Self
*Assistant Examiner* — Matthew G Katcoff
(74) *Attorney, Agent, or Firm* — DLA Piper LLP (US)

(57) ABSTRACT

A method of manufacturing a tubular member having a non-constant thickness by ironing at least a portion of the tubular material. The ironing apparatus can have a punch and a die, and the die can have a convex and concave side surface opposing the punch. The method can include bending an axial end portion of the tubular material to form a bent portion. The tubular material can then axially engage the die at the bent portion, and then the punch can be moved relative to the die to iron at least a portion of the tubular material.

5 Claims, 6 Drawing Sheets

(56) References Cited

U.S. PATENT DOCUMENTS

| | | | | |
|---|---|---|---|---|
| 4,346,581 | A * | 8/1982 | Ando | 72/347 |
| 4,408,379 | A * | 10/1983 | Kusano et al. | 29/894.353 |
| 4,956,989 | A | 9/1990 | Nakajima | |
| 5,845,400 | A * | 12/1998 | Takamoku | 29/894.354 |
| 5,921,130 | A | 7/1999 | Yamada | |
| 6,505,492 | B2 | 1/2003 | Jroski | |
| 6,978,649 | B1 * | 12/2005 | Alencar et al. | 72/105 |
| 7,111,910 | B2 | 9/2006 | Abe | |
| 7,171,838 | B2 * | 2/2007 | Shiokawa | 72/356 |
| 2004/0016124 | A1 | 1/2004 | Guimard | |

FOREIGN PATENT DOCUMENTS

| | | |
|---|---|---|
| JP | 7-088583 | 4/1995 |
| JP | 07-155882 | 6/1995 |
| JP | 10-166102 | 6/1998 |
| JP | 2000-288669 | 10/2000 |
| JP | 2004-230960 | 8/2004 |
| KR | 1993-0001084 | 2/1993 |
| KR | 2000-0043810 | 7/2000 |
| KR | 2000-0043810 A1 * | 7/2000 |

OTHER PUBLICATIONS

English Language Translation of JP 2004-512693 published Apr. 30, 2004.
English Language Abstract of JP 10-160376 published Jun. 19, 1998.
English Language Translation of JP 10-160376 published Jun. 19. 1998.
English Language Abstract of JP 56-131033 published Oct. 14, 1981.
International Search Report issued in PCT/JP2009/069529 mailed on Dec. 15, 2009.
International Preliminary Report on Patentability issued in PCT/JP2009/069529 mailed Jun. 16, 2011.
Korean Office Action issued in KR 2011-7003605 dated Sep. 24, 2012.
English Language Translation of Korean Office Action issued in KR 2011-7003605 dated Sep. 24, 2012.
Japanese Office Action issued in JP 2009-262425 on Dec. 11, 2012.
English Language Translation of Japanese Office Action issued in JP 2009-262425 on Dec. 11, 2012.
English Language Abstract of JP 07-155882 published on Jun. 20, 1995.
English Language Translation of JP 07-155882 published on Jun. 20, 1995.
English Language Abstract of JP 58-016751 published Jan. 31, 1983.
English Language Abstract of JP 10-166102 published Jun. 23, 1998.
English Language Translation of JP 10-166102 published Jun. 23, 1998.
English Language Abstract of KR-10-2000-0043810 published Jul. 15, 2000 (published as KR 10-0432616 on Jul. 15, 2000).
Korean Office Action issued in KR 10-2013-7026827 dated Jul. 14, 2014 with English Language Translation.
English Language Abstract and Translation of JP 2004-230960 published on Aug. 19, 2004.
International Search Report issued in PCT/JP2011/053201 on Apr. 26, 2011.
English Translation of International Search Report issued in PCT/JP2011/053201 on Apr. 26, 2011.
International Preliminary Report on Patentability issued in PCT/JP2011/053201 on Jun. 12, 2012.
English Translation of Article 34 Amendments in PCT/JP2011/053201 on Apr. 26, 2011.
U.S. Appl. No. 13/587,478.
English Language Abstract ofJP 2000-288669 published on Oct. 17, 2000.
English Language Translation ofJP 2000-288669 published on Oct. 17, 2000.
English Language Abstract ofJP 7-088583 published Apr. 4, 1995.
English Language Translation ofJP 7-088583 published Apr. 4, 1995.
English Language Abstract ofJP 61-042430 published Feb. 28, 1986.

* cited by examiner

METHOD OF MANUFACTURING A TUBULAR MEMBER

RELATED APPLICATIONS

This is a continuation of PCT/JP2009/069529, filed Nov. 18, 2009, currently pending, which claims priority to JP 2008-294272 filed on Nov. 18, 2008 and JP 2009-262425 filed on Nov. 18, 2009.

FIELD OF THE INVENTION

The present technology relates to a method of manufacturing a tubular member and, more particularly, a method of manufacturing a tubular member having a non-constant thickness from a tubular material.

DESCRIPTION OF RELATED ART

JP 2004-512963 discloses an annular member for use in a vehicle wheel rim having a non-constant thickness manufactured from a plate material having a constant thickness. In the manufacturing method of the vehicle rim of JP 2004-512963, a cylindrical hollow material having a constant thickness is manufactured from a flat plate material having a constant thickness, and then the cylindrical material is formed to a cylindrical hollow member having a non-constant thickness by flow-forming such as a flow-turning, spinning, etc. The cylindrical member is roll-formed to a rim configuration so that the vehicle rim having a non-constant thickness is manufactured.

SUMMARY OF THE INVENTION

This invention provides a method of manufacturing a tubular member. An axial end portion of a tubular material having a constant thickness is bent in a direction crossing an axial direction of the tubular material thereby forming a bent portion in the tubular material. The tubular material is ironed to form a tubular member having a non-constant thickness by ironing at least a portion of the tubular material other than the bent portion using an ironing apparatus which has a punch and a die having a convex and concave side surface opposing the punch.

BRIEF DESCRIPTION OF THE DRAWINGS

Specific examples have been chosen for purposes of illustration and description, and are shown in the accompanying drawings, forming a part of the specification.

- step (a) illustrates a tubular material,
- step (b) illustrates the tubular material after a bent portion is formed, the left half of (b) being a cross-sectional view of the material and the right half of (b) being a front view of the material,
- step (c) illustrates an ironing step, the left half of (c) illustrating the material before ironing and the right half of (c) illustrating the material after ironing, and
- step (d) illustrates a tubular member after ironing, the left half of (d) being a cross-sectional view of the member and the right half of (d) being a front view of the member.

Figure 2:
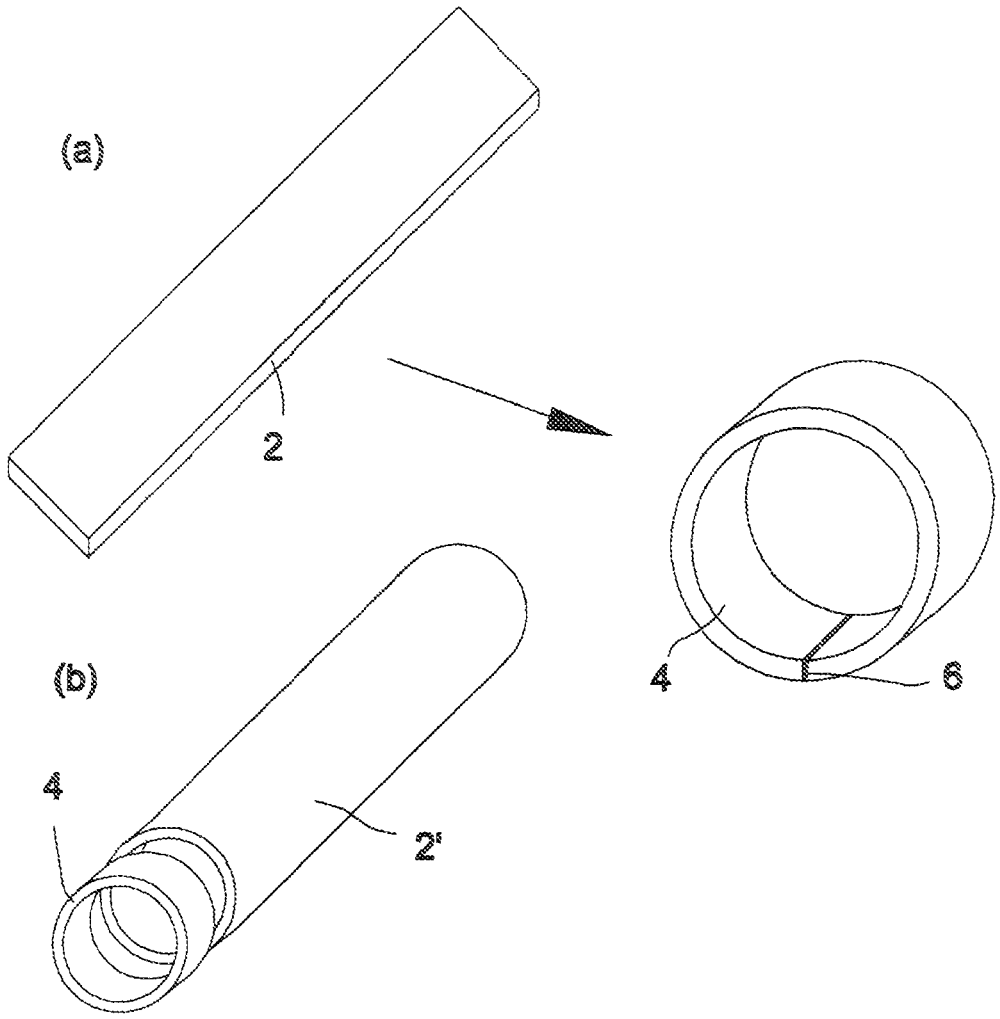

FIG. 2 is a process diagram illustrating a tubular material manufacturing step according to the first and second embodiments of the present technology, where:

- step (a) illustrates a step of rounding a plate material having a constant thickness to form a rounded material and then welding opposite ends of the rounded material to manufacture a pipe-like material, and
- step (b) illustrates a step of cutting the pipe-like material to a predetermined length to manufacture the tubular material.

Figure 3:
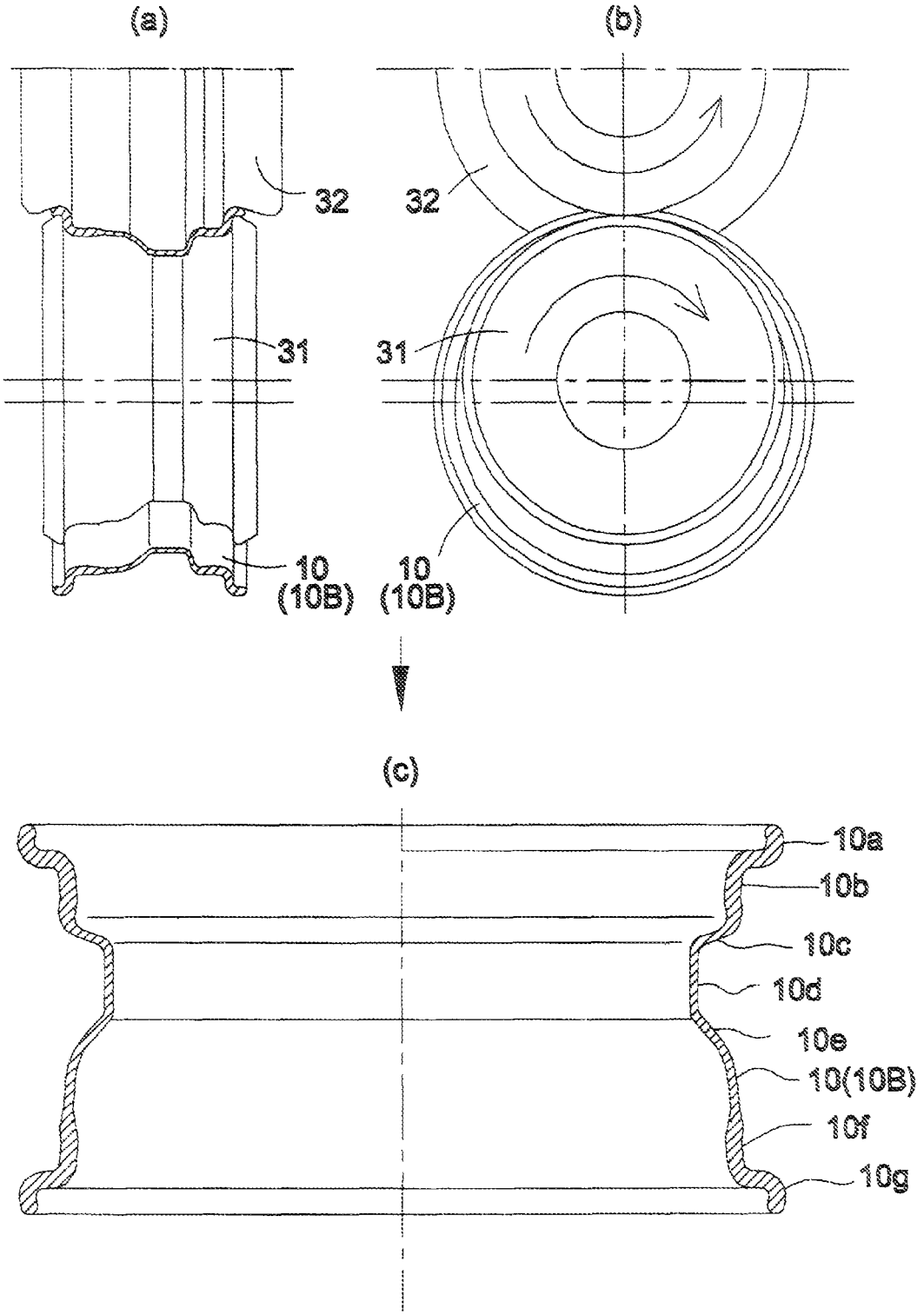

FIG. 3 is a process diagram illustrating a roll-forming step according to the first and second embodiments of the present technology, where:

- step (a) illustrates a side view of an upper roll and a lower roll between which a wall of the tubular member having a non-constant thickness is put and is roll-formed,
- step b) illustrates a front view of the upper roll and the lower roll between which the wall of the tubular member having a non-constant thickness is put and is roll-formed, and
- step (c) illustrates the tubular member having a rim configuration after roll-forming.

Figure 4:
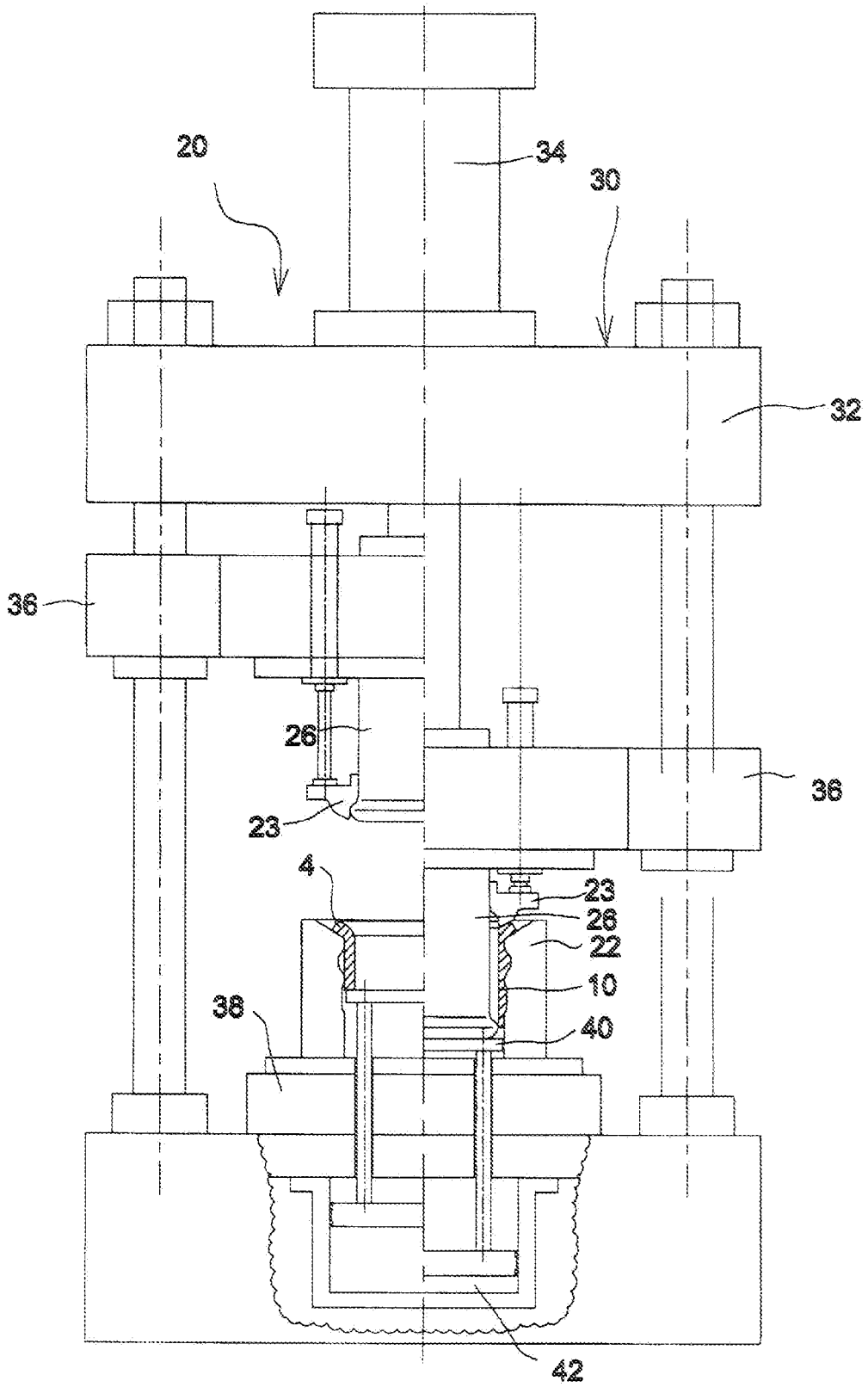

FIG. 4 is a cross-sectional view of an ironing apparatus used in a method of manufacturing a tubular member according to the first embodiment of the present technology, and is also applicable to the second embodiment of the present technology if a relationship of the die and the punch is reversed, where:

- the left half of FIG. 4 illustrates a state before ironing where the tubular material is inserted into the die, and
- the right half of FIG. 4 illustrates a state after ironing.

Figure 5:
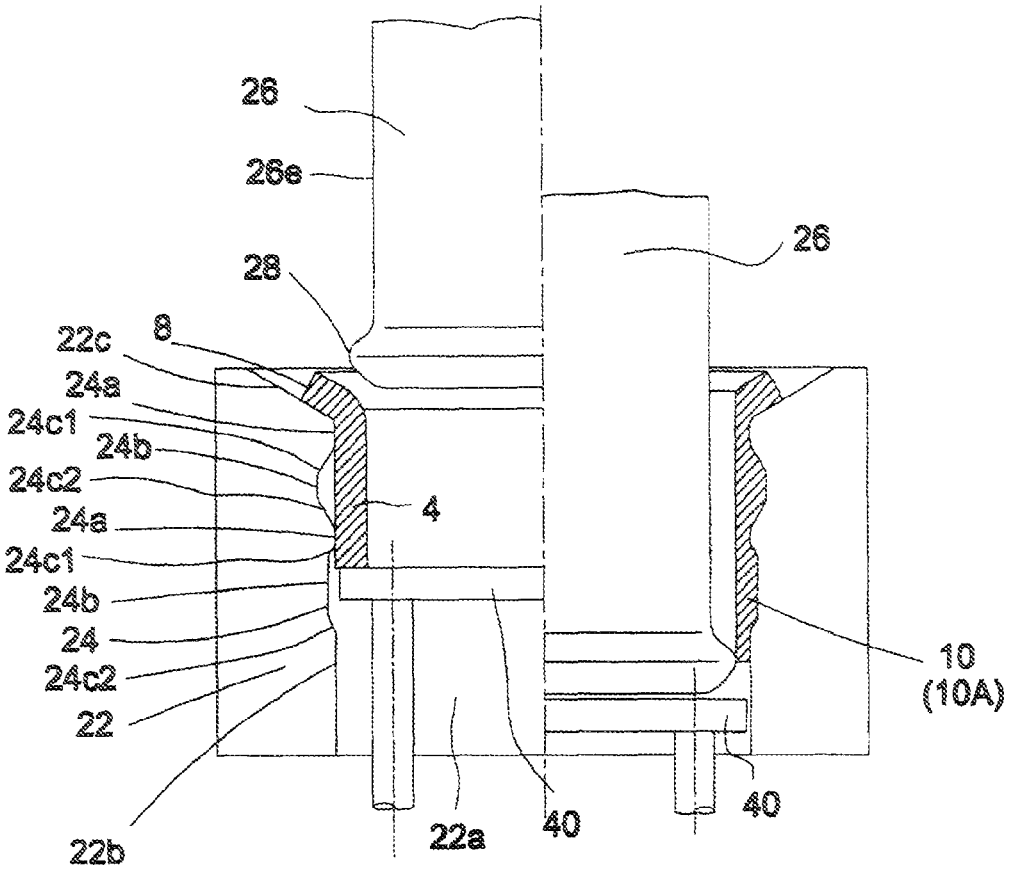

FIG. 5 is a partial cross-sectional view of a punch, a die, and a tubular material of a method of manufacturing a tubular member according to the first embodiment of the present technology.

Figure 6:
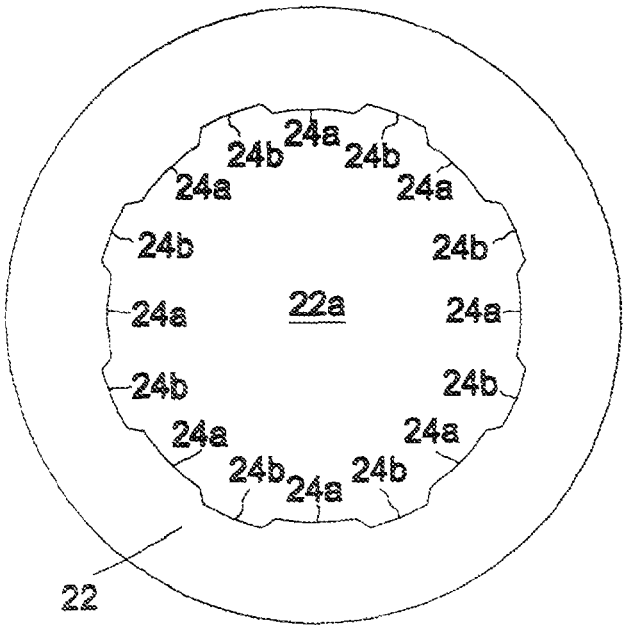

FIG. 6 is a cross-sectional view of the die (outer die) viewed in an axial direction of the die, of the method of manufacturing a tubular member according to the first embodiment of the present invention.

Figure 7:
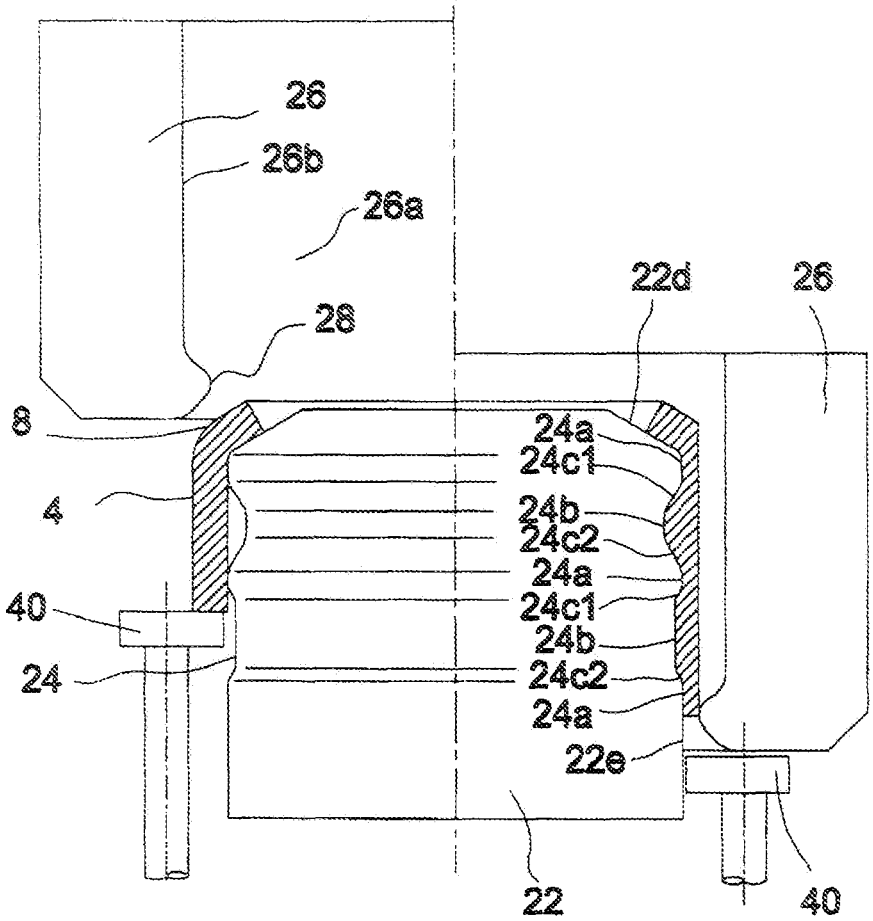

FIG. 7 is a partial cross-sectional view of a punch, a die and a tubular material, of a method of manufacturing a tubular member according to a second embodiment of the present invention, a left half of FIG. 7 illustrating a state before ironing and a right half of FIG. 7 illustrating a state after ironing.

Figure 8:
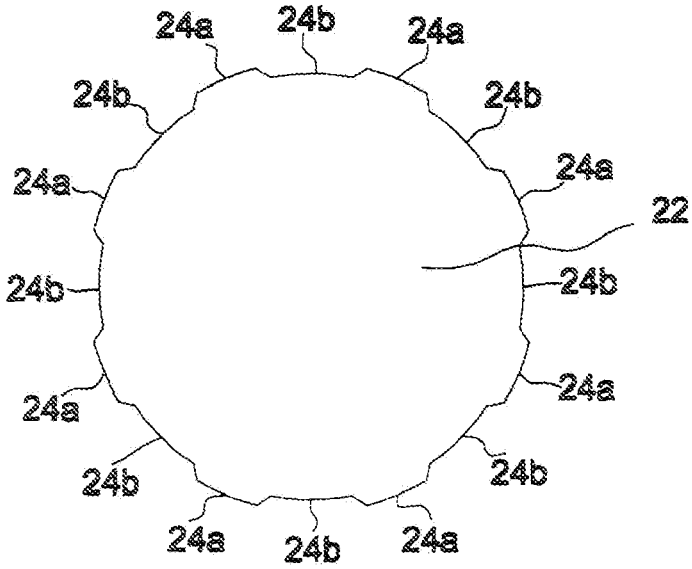

FIG. 8 is a cross-sectional view of the die (inner die) viewed in an axial direction of the die, of the method of manufacturing a tubular member according to the second embodiment of the present invention.

DETAILED DESCRIPTION

Specific examples of illustrative methods of manufacturing a tubular member according to the present technology will be explained with reference to the drawings. Portions common to the illustrated embodiments of the present technology are denoted with the same reference numerals throughout the Figures.

Figure 1:
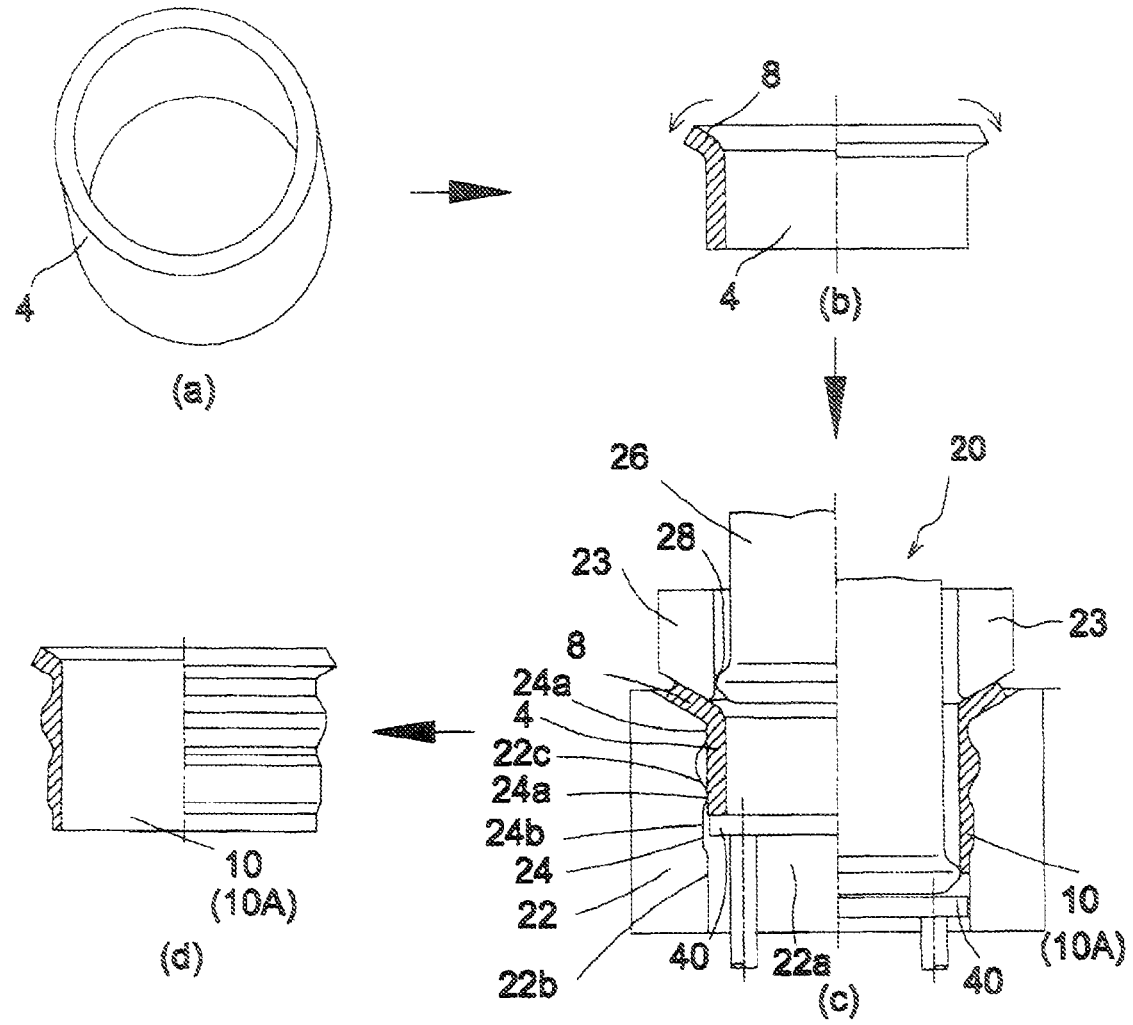
FIG. 1 is a process diagram illustrating a bent portion forming step and an ironing step used in a method of manufacturing a tubular member according to a first embodiment of the present technology, and is also applicable to a second embodiment of the present technology if the relationship of the die and the punch is reversed, where.

Generally, FIGS. 1-6 are applicable to a first embodiment of the present technology, and FIGS. 7 and 8 are applicable to a second embodiment of the present technology. However, FIGS. 2 and 3 are also applicable to the second embodiment of the present technology, and FIGS. 1 and 4 are applicable to the second embodiment of the present technology if the relationship of the die, the punch, and the pressing member is changed.

First, common portions of the present technology will be explained with reference to FIGS. 1-8.

FIGS. 1 and 3, illustrate methods of manufacturing tubular members 10 having a non-constant thickness from a tubular material 4. The tubular material 4 can be made from metal, and the metal can be, for example, steel, or a non-ferrous metal including, for example, aluminum, magnesium, titanium and alloys thereof. The tubular member 10 having a non-constant thickness can be a first tubular member 10A with a wall having an inner surface and an outer surface one of which is a convex and concave surface and the other of which is a straight surface extending parallel to an axis of the tubular member, or a second tubular member 10B with a wall formed so as to curve in a direction perpendicular to an axis of the tubular member 10B by further roll-forming the tubular member 10A. The tubular member 10A having a non-constant thickness can be, for example, a tubular member having an inner or outer surface portion extending parallel to the axis of the tubular member, except for a bent portion 8. The tubular member 10B can be, for example, a wheel rim for use in a car, a truck, a bus or an industrial vehicle. The tubular member 10B is not limited to the wheel rim. Further, the tubular member 10 (10A, 10B) is not limited to a member having a circular cross section, and can be a tubular member having a polygonal cross section or an ellipsoidal cross section.

As illustrated in FIG. 1, a method of manufacturing a tubular member 10 includes: (a) a bent portion forming step for bending an axial end portion of the tubular material 4 in a direction crossing an axial direction of the tubular material 4, thereby forming a bent portion 8 in the tubular material 4; and (b) an ironing step for manufacturing the tubular member 10 (10A) having a non-constant thickness using an ironing apparatus 20 having a punch 26, a die 22 having a convex and concave side surface 24 opposing the punch 26, and a pressing member 23.

Step (b) above can include steps of: causing the tubular material 4 to axially engage the die 22 at the bent portion 8; then moving the pressing member 23 relative to the die 22 thereby squeezing the bent portion 8 of the tubular material 4 between the pressing member 23 and the die 22; and then moving the punch 26 relative to the die 22 thereby ironing at least a portion of the tubular material 4 except the bent portion 8 and manufacturing the tubular member 10 (10A).

In the ironing step (c) of FIG. 1, the left half of step (c) illustrates a step where the bent portion 8 of the tubular material 4 is squeezed between the pressing member 23 and the die 22, and the right half of step (c) illustrates a step where by moving the punch 26 relative to the die 22 and ironing the tubular material 4, the tubular material 4 has been formed to the tubular member 10 (10A) having a non-constant thickness.

When the tubular material 4 has a shape which corresponds to the bent portion 8, and can engage the die 22 as in an example where the tubular material is a cast member, the bent portion forming step is not required to be provided.

Before the bent portion 8 forming step, as illustrated in step (a) of FIG. 2, a method of manufacturing a tubular member can include a tubular material manufacturing step for manufacturing a tubular material 4 having a constant thickness from a flat plate material 2 having a constant thickness. In the tubular material manufacturing step as illustrated in step (a) of FIG. 2, the flat plate material, shown as a rectangular material, can be manufactured by drawing out a plate having a constant thickness straight from a coil of the plate, and successively cutting the drawn-out straight plate at an interval of a predetermined length, thereby successively manufacturing a plurality of flat plate materials 2. Then, a flat material 2 can be rounded to form a rounded material and opposite ends of the rounded material can be welded to each other by flush butt welding, butt welding, and arc welding, etc., to form a welded portion 6. A burr of the welded portion 6 can be trimmed whereby a tubular material 4 having a constant thickness is manufactured.

Alternatively or in addition, as shown in the tubular material manufacturing step illustrated in step (b) of FIG. 2, the tubular material 4 having a constant thickness may be manufactured by cutting a pipe-like material 2' at an interval of a predetermined length.

In the example where a bent portion 8 is formed as illustrated in (b) of FIG. 1, the bent portion forming step can be carried out before the ironing step. In the ironing step as illustrated in (c) of FIG. 1, the bent portion 8 axially engages the die 22, thereby axially locating the tubular material 4 having a constant thickness relative to the die 22, and preventing the tubular material 4 from axially moving relative to the die 22 during ironing. The angle of the bent portion 8 can be from about 0 degrees to about 180 degrees inwardly or outwardly from the axial direction of the tubular material 4. The larger the angle is, the more effectively the tubular material 4 tends to be prevented from moving axially relative to the die 22. The tubular material 4 may be supplied to the ironing step without forming the bent portion 8 in the tubular material.

As illustrated in FIGS. 1 and 5, in the ironing step, the tubular material 4 having a constant thickness, and having a bent portion 8, can be set to the die 22 such that the tubular material 4 axially engages the die 22 by the bent portion 8. Then, the ironing apparatus 20 can be operated whereby the pressing member 23 and the punch 26 are moved relative to the die 22 (to approach the die) only in the axial direction of the tubular material 4. When the pressing member 23 and the punch 26 are moved relative to the die 22, the pressing member 23 first contacts the bent portion 8 of the tubular material 4 set to the die 22, thereby squeezing the bent portion 8 between the pressing member 23 and the die 22 (i.e., pressing the bent portion 8 of the tubular material 4 to the die 22 by the pressing member 23), and then the pressing member 23 can stop. The punch 26 further moves relative to the die 22 (approaches the die) only in the axial direction of the tubular material 4, thereby ironing the portion of the tubular material 4 except the bent portion 8 by the convex and concave surface 24 of the die 22 and the punch 26, accompanied by a change in the diameter and the thickness of the tubular material 4.

While the tubular material 4 is ironed, the tubular material 4 can be lengthened (extended) in the axial direction of the tubular material 4.

In an example where a force required in ironing is small, the pressing member 23 can be removed.

The ironing apparatus 20 can be installed in a stamping machine 30 as shown in FIG. 4.

The stamping machine 30 includes a frame 32, a ram driving apparatus 34 coupled to the frame 32, a ram 36 moved in a vertical direction by the ram drive apparatus 34, a bolster 38, a material supporting and ejecting plate 40, and a plate drive apparatus 42 connected to the material supporting and ejecting plate 40 and giving a material ejecting force to the material supporting and ejecting plate 40. The die 22 can be fixed to the bolster 38, or to a member fixed to the bolster 38, and the punch 26 can be fixed to the ram 36 or a member fixed to the ram 36. When the ram drive apparatus 34 is operated (i.e., the stamping machine 30 is operated) to lower the ram 36, the punch 26 moves (approaches the die) only in the axial direction of the tubular material 4 relative to the die 22.

The ram drive apparatus 34 of the stamping machine 30 can be a hydraulic press apparatus using a hydraulic cylinder, a mechanical press apparatus using a motor and a crank shaft, or a servo drive press apparatus using a servo motor and a ball screw. The plate drive apparatus 42 can be a hydraulic cylinder, an air cylinder, or an elevator mechanism using an electric motor.

The die 22 can be a fixed, and the punch 26 can be a movable. As illustrated in (c) of FIG. 1, the side surface of the die 22 opposing a protrusion 28 of the punch 26 is the convex and concave surface 24. The convex and concave surface 24 can be a surface whose space from the protrusion 28 of the punch 26 (a space in a thickness direction of the tubular material 4 having a constant thickness) is not constant. In some examples, in order to make the space between the protrusion 28 of the punch 26 and the side surface of the die 22 opposing the protrusion 28 of the punch 26, the convex and concave surface 24 of the die 22 may be formed:

(a) by providing at least one convex portion 24*a* convex toward the protrusion 28 of the punch 26 relative to an adjacent portion. (i.e., a concave portion 24*b*) in an axial direction of the die along the side surface of the die 22 as illustrated in FIG. 5;

(b) by providing at least one convex portion 24*a* convex toward the protrusion 28 of the punch 26 relative to an adjacent portion (i.e., a concave portion 24*b*) in a circumferential direction of the die along the side surface of the die 22 as illustrated in FIG. 6; or (c) by a combination of (a) and (b) above.

The amount that the convex portion 24*a* protrudes can be determined by an objective thickness of a corresponding portion of the tubular member 10, and may be constant or non-constant in a range of each convex portion 24*a*. Further, in an example where a plurality of convex portions 24*a* are provided, the amounts by which the respective convex portions 24*a* protrude can be determined by objective thicknesses of corresponding portions of the tubular member 10, and the protruding amounts of the respective convex portions 24*a* may be equal or not equal to each other. The convex portion 24*a* can be provided along at least a portion of the side surface of the die 22 opposing the protrusion 28 of the punch 26.

As illustrated in FIG. 5, in the axial direction of the die 22 along the side surface of the die, one convex portion 24*a* and a concave portion 24*b*, which is located after the convex portion 24*a* in a moving direction of the punch 26 during ironing and is adjacent to the one convex portion 24*a*, can be connected via a first inclined surface 24*c*1 which is not perpendicular to the axis of the die 22 and forms a portion of the side surface of the die. In this example, due to the inclined surface not being perpendicular to the axis of the die, the tubular member 10A is not-liable to interfere with the convex portion 24*a* and can be smoothly taken out from the die 22 when an ejecting force is loaded on the tubular member 10A from the material supporting and ejecting plate 40.

Further, in the axial direction of the die 22 along the side surface of the die, one convex portion 24*a* and a concave portion 24*b*, which is located ahead of the material supporting and ejecting plate 40 in a moving direction of the material supporting and ejecting plate 40 during ejecting the tubular member 10 (10A) from the die 22 and is adjacent to the one convex portion 24*a*, can be connected via a second inclined surface 24*c*2 which is not perpendicular to the axis of the die 22 and forms a portion of the side surface of the die. In this example, due to the inclined surface not being perpendicular to the axis of the die, the tubular member 10A is not-liable to interfere with the convex portion 24*a* and can be smoothly taken out from the die 22 when an ejecting force is loaded on the tubular member 10A from the material supporting and ejecting plate 40.

Angles of the first inclined surface 24*c*1 and the second inclined surface 24*c*2 from the axial direction of the die 22 along the side surface of the die 22 can preferably be set at an angle equal to or smaller than about 60 degrees, and more preferably at an angle equal to or smaller than about 45 degrees. An inclination angle of each first inclined surface 24*c*1 may be constant, or may change gradually. An inclination angle of each second inclined surface 24*c*2 may be constant, or may change gradually.

The punch 26 has the protrusion 28 protruding toward the die 22 at a fore end portion of the punch as the punch moves toward the die 22 and irons the tubular material 4 by the protrusion 28.

The material supporting and ejecting plate 40 can receive and support the tubular material 4 (in the axial direction of the tubular material 4) from a direction opposite to the direction that the punch 26 moves during ironing (the direction in which the punch 26 pushes the tubular material 4), in order that the axial end portion of the tubular material 4 opposite the bent portion 8 does not extend axially more than an expected extending amount during ironing and is not offset from an expected position relative to the die 22. The axial length of the tubular material 4 can be gradually lengthened when the tubular material 4 is ironed. The position of the material supporting and ejecting plate 40 can be controlled by the plate drive apparatus 42. The material supporting and ejecting plate 40 can be receded according to a change in the axial length of the tubular material 4. The material supporting and ejecting plate 40 can push the tubular material 4 in the axial direction of the tubular material at a constant force, or at a substantially constant force, during ironing. The load operating on the material supporting and ejecting plate 40 may be controlled, or the amount of displacement of the material supporting and ejecting plate 40 may be controlled.

As illustrated in (c) of FIG. 1, in the ironing step, after the punch 26 has been lowered and the tubular member 10 (10A) has been manufactured, the punch 26 can be extracted from the die 22. After the punch 26 is extracted from the die 22, or when the punch 26 is being extracted from the die 22, an axial force from the material supporting and ejecting plate 40 can be loaded on the tubular member 10 (10A) thereby removing the tubular member 10 (10A) from the die 22.

In a case where the tubular member 10 (10A) is a member for a vehicle wheel rim, a rate of change of the diameter of the tubular member 10 (10A) necessary to remove the tubular member 10 (10A) from the die 22 is about 1.2% at a maximum, which is in the range of an elastic deformation. Therefore, the tubular member 10 (10A) can be removed from the die 22 by elastically deforming the tubular member 10 (10A) in a radial direction of the tubular member 10 (10A) (i.e., in a thickness direction of the tubular member 10 (10A)) by the axial force from the material supporting and ejecting plate 40. The tubular member 10 (10A) may also be removed from the die 22 by plastically deforming the tubular member 10 (10A) in the radial direction of the tubular member 10 (10A) even in the case where the tubular member 10 (10A) is a member for a vehicle wheel rim.

The material supporting and ejecting plate 40 can push the tubular member 10 (10A) in the direction opposite the direction in which the punch 26 moves during ironing (the direction in which the punch 26 pushes the tubular material 4). The axial force which the material supporting and ejecting plate 40 can impose on the tubular member 10 (10A) when removing the tubular member 10 (10A) can be equal to or larger than a force necessary to deform the tubular member 10 (10A) in the radial direction of the tubular member, thereby removing the tubular member 10 (10A) when the material supporting and ejecting plate 40 axially pushes the tubular member 10 (10A). The axial force is much smaller than the ironing force with which the punch 26 axially pushes the tubular material 4. Since the die 22 is not required to be divided in the circumferential direction of the die to remove the tubular member 10 (10A), the die 22 need not be divided, and can be constructed to be an integral die.

The tubular member 10 having a non-constant thickness includes a thick portion (e.g., a portion where the thickness is not thinned) and a thin portion (e.g., a portion where the thickness is thinned). The thick portion of the tubular member 10 can correspond to a portion where large force is imposed (in the case of a wheel rim, a curved portion and a flange portion of the rim) during use of the final product. The thin portion can correspond to a portion where small force is imposed (in the case of the wheel rim, a portion other than the curved portion and the flange portion of the rim) during use of the final product. Owing to such structures, lightening, material savings and cost reduction are obtained while maintaining, a desired strength and rigidity in the final product.

As illustrated in FIG. 3, a method of Manufacturing the tubular member 10 according to the present technology may include a step of roll-forming the tubular member 10 (10A) having a non-constant thickness to form a vehicle wheel rim configuration after the ironing step. A vehicle wheel rim having a non-constant thickness is one example of a tubular member 10 (10B).

Such a roll-forming step is performed after axially opposite ends of the tubular member 10A having a non-constant thickness are flared (not shown). In the roll-forming step, a wall of the tubular member 10A can be squeezed between a lower roll 31 and an upper roll 32, and then the rolls can be rotated, thereby forming the tubular member 10A into the tubular member 10B having a rim configuration. Then, the tubular member 10B can be sized (formed to a true circle and a rim configuration) to a final rim configuration using an expander and/or a shrinker.

In the illustrated example, the rim constructed of the tubular member 10 (10B) includes a flange portion 10*a*, a bead seat portion 10*b*, a side wall portion 10*c*, a drop portion 10*d*, a side wall portion 10*e*, a bead seat portion 10*f* and a flange portion 10*g*, in that order from one axial end to the other axial end of the rim. A disk (not shown) can be fit to the rim and then welded to the rim, whereby a wheel of a welded type can be manufactured. Curved portions can exist between the above portions of the rim listed. Larger stresses can be generated at the curved portions and the flange portions 10*a* and 10*g* than stresses generated at other portions. Preferably, the thicknesses of the curved portions and the flange portions 10*a* and 10*g* are made greater than thicknesses of other portions.

Next, structures unique to the illustrated embodiments of the present technology will be explained.

First Embodiment

In the method of manufacturing the tubular member 10 according to a first embodiment of the present technology, as illustrated in FIGS. 1 and 5, the die 22 can be constructed of an outer die having a cylindrical bore 22*a* and an inner side surface 22*b*. The inner side surface 22*b* of the outer die can be constructed to be the convex and concave surface 24. The punch 26 can be constructed of an inner punch which moves into or out from the cylindrical bore 22*a* of the outer die 22. The protrusion 28 can be formed at an outside surface 26*e* of the inner punch.

As illustrated in FIG. 5, a flange receiving portion 22*c*, which the bent portion 8 of the tubular material 4 engages, can be formed at an upper end portion of the inner side surface 22*b* of the outer die 22. The tubular material 4 can be set to the outer die 22 by causing the bent portion 8 to contact and engage the flange receiving portion 22*c*.

An inner diameter of a portion of the outer die 22 where the convex portion 24*a* is provided can be larger than an outer diameter of a portion of the tubular material 4 other than the bent portion 8 before ironing. Therefore, the tubular material 4 before ironing can be set to the outer die 22.

An outer diameter of the protrusion 28 of the inner punch 26 can be larger than an inner diameter of the tubular material 4 other than the bent portion 8 before ironing. Therefore, a convex and concave configuration of the convex and concave surface 24 of the die 22 can be transferred to the tubular material 4 by pushing the tubular material 4 to the die 22 during ironing.

A difference between an outer radius of the protrusion 28 of the inner punch 26 and an inner radius of the portion of the outer die 22 where the convex portion 24*a* is provided can be smaller than the thickness of the tubular material 4 before ironing. Therefore, the thickness of the tubular material 4 can be thinned by ironing at the convex portion 24*a*.

When the punch 26 is moved into the cylindrical bore 22*a* of the outer die 22 by the ironing apparatus 20 (the stamping machine 30), the protrusion 28 of the punch 26 irons the tubular material 4 thereby enlarging the diameter of the tubular material 4, and the portion of the outer die 22 where the convex portion 24*a* is provided can thin the thickness of the tubular material 4.

In a case where a difference between the inner radius of the portion of the outer die 22 where the convex portion 24*a* is not provided and the outer radius of the protrusion 28 of the inner punch 26 is equal to or larger than the thickness of the tubular material 4 before ironing, the thickness of the tubular material 4 can not be thinned during ironing. The thickness of the tubular material 4 can be thickened relative to an initial thickness of the tubular material 4, and by controlling the material supporting and ejecting plate 40 for receiving the tubular material 4, the thickness of the tubular material 4 can be thickened even more.

When the tubular material 4 is ironed, inner punch 26 creates forces applied to the tubular material 4 in the axial direction. Axial movement of the tubular material 4 can be suppressed in examples of the present technology where the bent portion 8 of the tubular material 4 engages the flange receiving portion 22*c* of the outer die 22, because the bent portion 8 of the tubular material 4 can be squeezed between the pressing member 23 and the die 22, and because the material supporting and ejecting plate 40 can receive the tubular material 4 in a direction opposite the direction where the inner punch 26 pushes the tubular material 4. As a result, the axial positions of a thick portion and a thin portion formed in the tubular member 10 can be prevented from being offset relative to the axial positions of the convex and concave surface 24 of the outer die 22. In a wheel rim 10 (10B) manufactured by roll-forming the tubular member 10 (10A), a portion where a relatively large thickness is required is thick, and a portion where a relatively large thickness is not required is thin, so that the wheel rim 10 (10B) is light.

The die 22 can be constructed of the outer die having the cylindrical bore 22*a* and the inner side surface 22*b* which can be the convex and concave surface 24, and the punch 26 can be constructed of the inner punch which moves into and out from the cylindrical bore 22*a* of the outer die 22. The outer die 22 can be fixed to the bolster 38 located at a lower portion of the ironing apparatus 20 (and the stamping machine 30), and the inner punch 26 can be fixed to the ram 36 located at an upper portion of the ironing apparatus 20 (and the stamping machine 30). The inner punch 26 can be moved up and down in the vertical direction relative to the outer die 22. By this structure, an ironing apparatus 20 (and the stamping machine 30) can be used for manufacturing of the tubular member 10 (10A).

Second Embodiment

In a method of manufacturing the tubular member 10 according to the second embodiment of the present technology, as illustrated in FIGS. 7 and 8, the die 22 can be constructed of an inner die having an outer side surface 22*e*. The outer side surface 22*e* of the inner die 22 can be constructed to be the convex and concave surface 24. The punch 26 can be constructed of an outer punch having an cylindrical bore 26*a* and an inner side surface 26*b*. The protrusion 28 can be formed at the inner side surface 26*b* of the outer punch.

A flange receiving portion 22*d*, which the bent portion 8 of the tubular material 4 engages, can be formed at an upper end portion of the outer side surface 22*e* of the inner die 22. The tubular material 4 can be set to the inner die 22 by causing the bent portion 8 to contact and engage the flange receiving portion 22*d*.

An outer diameter of a portion of the inner die 22 where the convex portion 24*a* is provided can be smaller than an inner diameter of a portion of the tubular material 4 other than the bent portion 8 before ironing. Therefore, the tubular material 4 before ironing can be set to the inner die 22.

An inner diameter of the protrusion 28 of the outer punch 26 can be smaller than an outer diameter of the tubular material 4 other than the bent portion 8 before ironing. Therefore, an convex and concave configuration can be transferred to the tubular material 4 by pushing the tubular material 4 to the die 22 during ironing.

A difference between an inner radius of the protrusion 28 of the outer punch 26 and an outer radius of the portion of the inner die 22 where the convex portion 24*a* is provided can be smaller than the thickness of the tubular material 4 before ironing. Therefore, the thickness of the tubular material 4 can be thinned by ironing.

When the outer punch 26 is moved toward the inner die 22 and the inner die 22 enters the cylindrical bore 26*a* of the outer punch 26, the protrusion 28 of the outer punch 26 can iron the tubular material 4 thereby shrinking the diameter of the tubular material 4, and the portion of the inner die 22 where the convex portion 24*a* is provided can thin the thickness of the tubular material 4.

In a case where a difference between the outer radius of the portion of the inner die 22 where the convex portion 24*a* is not provided and the inner radius of the protrusion 28 of the outer punch 26 is equal to or larger than the thickness of the tubular material 4 before ironing, the thickness of the tubular material 4 can not be thinned during ironing. The thickness of the tubular material 4 can be thickened relative to an initial thickness of the tubular material.

When the tubular material 4 is ironed, outer punch 26 creates forces applied to the tubular material 4 in the axial direction. Axial movement of the tubular material 4 can be suppressed because the bent portion 8 of the tubular material 4 can engage the flange receiving portion 22*d* of the inner die 22, because the bent portion 8 of the tubular material 4 can be squeezed between the pressing member 23 (not shown in FIG. 7) and the die 22, and because the material supporting and ejecting plate 40 can receive the tubular material 4 in a direction opposite the direction where the outer punch 26 pushes the tubular material 4. As a result, the axial positions of a thick portion and a thin portion formed in the tubular member 10 can be prevented from being offset relative to the axial positions of the convex and concave surface 24 of the inner die 22. In a wheel rim manufactured by roll-forming the tubular member 10 (10A), a portion where a relatively large thickness is required can be thick, and a portion where a relatively large thickness is not required can be thin, so that the wheel rim 10 (10B) can be light.

The die 22 can be constructed of the inner die having the outer side surface which is the convex and concave surface 24, and the punch 26 can be constructed of the outer punch having the cylindrical bore 26*a* and the inner side surface. The inner die 22 can be fixed to the lower bolster 38 of the ironing apparatus 20 (the stamping machine 30), and the outer punch 26 can be fixed to the upper ram 36 of the ironing apparatus 20 (the stamping machine 30). The outer punch 26 can be stroked in the vertical direction relative to the inner die 22. By this structure, the ironing apparatus 20 (the stamping machine 30) can be used for manufacturing of the tubular member 10 (10A).

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A method of manufacturing a tubular member comprising:

bending an axial end portion of a tubular material having a constant thickness in a direction crossing an axial direction of the tubular material thereby forming a bent portion, bent and extending in the direction crossing the axial direction of the tubular material, in the tubular material; and ironing the tubular material to form a tubular member having a non-constant thickness by ironing at least a portion of the tubular material other than the bent portion using an ironing apparatus which has a punch and a die having a convex and concave side surface opposing the punch;

wherein during the entire ironing, the tubular material is received and supported by a material supporting and ejecting plate from a direction opposite to the direction in which the punch pushes the tubular material, a die-facing surface of the portion of the tubular material other than the bent portion formed at the axial end portion of the tubular material is formed to a convex and concave surface of the tubular member, and a punch-facing surface of the portion of the tubular material other than the bent portion formed at the axial end portion of the tubular material is formed to a straight surface of the tubular member extending in an axial direction of the tubular member;

wherein the convex and concave surface of the die is formed by providing the die with at least one convex portion making a space between the die and the punch narrower than the thickness of the tubular material before ironing, in an axial direction of the die along the side surface of the die opposing the punch, whereby a thickness of a portion of the tubular member after ironing at least corresponding to the at least one convex portion of the die is smaller than the thickness of the tubular material before ironing; and wherein the ironing includes:

causing the bent portion to axially engage the die;

operating the ironing apparatus by moving one of the punch and the die relative to the other of the punch and the die; and ironing the tubular material to form the tubular member accompanied by a change in a diameter and a thickness of the tubular material caused by the convex and concave surface of the die and the punch.

2. A method of manufacturing a tubular member according to claim 1, wherein after manufacturing the tubular member having a non-constant thickness, the tubular member is taken out from the die by adding an axial force to the tubular member so that the tubular member is deformed in a radial direction of the tubular member.

3. A method of manufacturing a tubular member according to claim 1, wherein the bent portion of the tubular material is caused to axially engage the die and is squeezed between the die and a pressing member and then the ironing is performed.

4. A method of manufacturing a tubular member according to claim 1, further comprising manufacturing the tubular material from a flat material having a constant thickness before the ironing.

5. A method of manufacturing a tubular member according to claim 1, further comprising roll-forming the tubular member having a non-constant thickness to form a vehicle wheel rim.

* * * * *